US006616319B2

(12) United States Patent
Renz

(10) Patent No.: US 6,616,319 B2
(45) Date of Patent: Sep. 9, 2003

(54) BOTTLE WITH MIXING SYSTEM

(75) Inventor: Charles J. Renz, Briarcliff Manor, NY (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 10/198,634

(22) Filed: Jul. 18, 2002

(65) Prior Publication Data

US 2003/0029827 A1 Feb. 13, 2003

Related U.S. Application Data

(60) Provisional application No. 60/306,270, filed on Jul. 18, 2001.

(51) Int. Cl.[7] ..... A61J 9/00; A61J 11/00; B65D 23/12

(52) U.S. Cl. ..... 366/130; 215/11.1; 215/11.3; 215/386; 215/DIG. 8

(58) Field of Search ..... 366/129, 130, 366/189, 336, 340, 347; 220/568; 206/219, 221; 215/11.1, 11.3, 11.6, 228, 386, DIG. 8; D24/197

(56) References Cited

U.S. PATENT DOCUMENTS

| | | | |
|---|---|---|---|
| 1,075,119 | A | 10/1913 | Reichner |
| 1,672,466 | A | 6/1928 | Oshman et al. |
| 1,672,467 | A | 6/1928 | Oshman et al. |
| 1,878,924 | A | 9/1932 | Will |
| 2,669,946 | A | 2/1954 | Peyton |
| 3,204,855 | A | 9/1965 | Boynton et al. |
| 3,677,524 | A | 7/1972 | Douglas |
| 3,747,414 | A | 7/1973 | Ohno |
| 3,763,542 | A | 10/1973 | Gutnajer |
| 3,820,692 | A | 6/1974 | Swett et al. |
| 4,003,555 | A | 1/1977 | Swartz |
| 4,238,040 | A | 12/1980 | Fitzpatrick |
| 4,533,057 | A | 8/1985 | Klittich |
| 4,818,114 | A | 4/1989 | Ghavi |
| 5,353,964 | A | 10/1994 | Liu et al. |
| 5,419,445 | A | 5/1995 | Kaesemeyer |
| 5,547,275 | A | 8/1996 | Lillelund et al. |
| D374,150 | S | 10/1996 | Lillelund |
| 5,788,369 | A | 8/1998 | Tseng |
| 5,794,802 | A | 8/1998 | Caola |
| 5,992,693 | A | 11/1999 | Albisetti |
| 6,059,443 | A | 5/2000 | Casey |
| 6,089,389 | A | 7/2000 | Sharon et al. |
| 6,092,681 | A | 7/2000 | Shaw et al. |
| 6,113,257 | A | 9/2000 | Sharon et al. |
| 6,244,452 | B1 | 6/2001 | Morano et al. |
| D451,200 | S | 11/2001 | Johansen et al. |
| 6,332,704 | B1 * | 12/2001 | Gasser et al. |

FOREIGN PATENT DOCUMENTS

| | | | |
|---|---|---|---|
| DE | 2908526 | * | 4/1980 |
| GB | 327661 | * | 7/1930 |

* cited by examiner

*Primary Examiner*—Charles E. Cooley
(74) *Attorney, Agent, or Firm*—Ohlandt, Greeley, Ruggiero & Perle, LLP

(57) ABSTRACT

There is provided an infant feeding bottle system having an agitator for mixing a powder substance with a liquid in a non-rigid disposable liner. The bottle system permits a user to mix powdered formula directly inside a non-rigid liner. The bottle system enhances the mixing effect, resulting in improved solubility, and provides for a self-contained uninterrupted mixing and feeding process.

38 Claims, 8 Drawing Sheets

BOTTLE WITH MIXING SYSTEM

RELATED APPLICATION

This application is related to and claims priority in, copending U.S. Provisional Application Ser. No. 60/306,270, filed Jul. 18, 2001, the disclosure of which is incorporated herein by reference.

BACKGROUND OF THE INVENTION

1. Field of the Invention

The present invention relates to an infant feeding bottle and, more particularly, to an infant feeding bottle system having an agitator for mixing a powder substance with a liquid. More particularly, the system can mix a powdered substance and a liquid in a disposable liner. The system provides for improved mixing and allows for uninterrupted mixing and feeding.

2. Description of the Prior Art

The traditional infant feed bottle has a rigid bottle body having an open upper end, a nipple and a fastening ring used to affix the nipple to the open upper end of the bottle body. The traditional bottle does not efficiently and adequately mix powdered baby formula with a liquid. To mix powdered baby formula with a liquid using a traditional infant feed bottle requires the following steps: (1) add a specified amount of liquid to the rigid bottle body, (2) add a certain amount of powdered formula, (3) affix the nipple to the rigid bottle body with the fastening ring, and (4) hand shake the infant feed bottle until the powdered formula is adequately dissolved in the liquid. This process is deficient in that undissolved lumps of powdered formula are often formed. This can lead to congestion of the nipple outlet, thus affecting the free flow of fluid out of the nipple and resulting in unnecessary waste.

A number of rigid infant feeding bottles have been designed to improve the bottle formula mixing process. For example, bottles have been designed that use separate compartments to keep a powdered formula and a liquid separated until mixing is desired. Typical designs for this type of bottle utilize a displaceable partition that separates the compartments. For example, U.S. Pat. No. 5,794,802 to Caola describes a baby bottle having an insert that forms a storage compartment for holding powdered formula prior to being mixed with a liquid stored in the bottle. To mix the formula with the liquid, a user pushes on a nipple assembly fastened to the bottle to displace a seal that separates the storage compartment from the liquid in the bottle. This action provides a passage for the liquid and powdered formula to combine in the bottle and storage compartment. The bottle can then be shaken to facilitate the dissipation of the formula into the liquid.

It is also known to provide a rigid infant feeding bottle or system having a device that facilitates in the mixing of powdered formula into liquid. For example, U.S. Pat. No. 5,788,369 to Tseng, describes an infant feeding bottle with a mixing element mounted on an affixing ring and having a stirring body made up of stirring ribs that protrude inwardly from the ring into the bottle.

Another example of a device designed and used to facilitate in the mixing of powdered formula into liquid is found in U.S. Pat. No. 4,818,114 to Ghavi. This patent describes a device that can be attached to a baby bottle and uses a mixing disc having a plurality of uniformly spaced arms radiating from a central post that act as a handle to aid in the handling of the mixing disc. The arms of the mixing disc have a diamond shaped cross section to produce multiple shear points and increase turbulence during the mixing process.

It is also known to provide an infant feeding bottle with a non-rigid liner-type or disposable feeding system that uses a sterilized and disposable liner that is removably supported within a rigid tubular holder. An example of this type of disposable feeding system is described in U.S. Pat. No. 3,763,542. This disposable liner infant feeding system is popular among parents that are mobile and often unable to find facilities that are adequate to wash and/or sterilize infant feeding devices. However, there are problems with this system. The process is clumsy and time consuming. The required steps include: (1) pour liquid and powdered formula into a rigid container and shake or stir until the powder formula is adequately dissolved into the liquid, (2) remove a nipple and fastening ring from a holder and pour the liquid formula mix into a liner, and (3) reaffix the nipple and fastening ring to the holder and proceed with feeding an infant.

An alternative is to mix the powdered formula and liquid directly inside a disposable liner assembled in a holder. The problem with this is that, in a non-rigid disposable liner, the powdered formula does not dissolve in a liquid as well when shaken. The liquid tends to move with the liner, thereby creating less turbulence within the liner for the powdered formula to dissolve into the liquid. This inefficient mixing process results in a lumpy liquid formula mix.

SUMMARY OF THE INVENTION

It is an object of the present invention to provide an infant feeding bottle or system having a disposable liner.

It is another object of the present invention to provide such a system that enables a user to effectively and efficiently mix a powdered formula with liquid directly inside a non-rigid disposable liner.

It is still another object of the present invention to provide such an infant feeding bottle having a disposable liner system that comprises a tubular holder having a wider bottom and narrower top.

It is yet another object of the present invention to provide an agitator that seats inside a liner to aid in the mixing of a powdered formula with liquid.

It is a further object of the present invention to provide an agitator that secures a liner in place while a user presses out any excess air in the liner.

It is still a further object of the present invention to provide an agitator having a handle for ease of insertion and removal.

It is yet a further object of the present invention to provide a method for the uninterrupted formula mixing and feeding.

These and other objects and advantages of the present invention are achieved by an agitator for mixing components in a container assembly having a flexible liner. The agitator comprises an annular ring forming a hole therethrough, a connecting member and a spoke having a fin. The connecting member secures the spoke to the annular ring and the spoke forms a plurality of apertures. The annular ring has an outer surface and can have a securing member for disposing the agitator at least partially in the flexible liner. The securing member can be an annular bead extending from the outer surface. The fin can be an upper fin and a lower fin. The annular ring, the connecting member and the spoke can form a cup-like shape. The hole is in a first plane, the spoke is in a second plane, and the first plane and the second plane can be substantially parallel. The fin is in a third plane and the first plane and the third plane can be substantially perpendicular.

The connecting member can be a plurality of partitions. The annular ring has a longitudinal center axis and the partitions can extend from the annular ring towards the axis. The partitions can be substantially equally spaced apart. The spoke can be a plurality of spokes with each of the spokes having a first end and a second end. Each of the first ends can be connected to the connecting member, and each of the second ends can be connected to each other at a hub. The hub can be centrally located, and can have a handle. The spokes can be substantially equally spaced apart.

The present invention is also a container assembly for mixing components in a flexible liner. The assembly comprises a holder having a body with a first open end and a second end, a flexible liner having an open end and an inner volume, an agitator, a nipple and a fastening ring. The holder, liner, agitator, nipple and fastening ring are secured together to form the assembly. The agitator has an annular ring at least partially disposed through the liner open end and in the inner volume. The annular ring forms a hole therethrough. The agitator can comprise a connecting member and a spoke having a fin. The connecting member can secure the spoke to the annular ring and the spoke can form a plurality or number of apertures. The annular ring has an outer surface and can have a securing member for fastening the agitator to the liner. The securing member can be an annular bead extending from the outer surface. The fin can be an upper fin and a lower fin. The annular ring, connecting member and spoke can form a cup-like shape.

The hole is in a first plane, the spoke is in a second plane, and the first plane and the second plane can be substantially parallel. The fin is in a third plane, and the first plane and the third plane can be substantially perpendicular. The connecting member can be a plurality of partitions. The annular ring has a longitudinal center axis and the partitions can extend from the annular ring towards the axis. The partitions can be substantially equally spaced apart. The spoke can be a plurality of spokes with each spoke having a first end and a second end. Each first end can be connected to the connecting member and each second end can be connected to each other at a hub. The hub can have a handle, and can be centrally located. The spokes can be substantially equally spaced apart.

The second end of the holder can be open. The holder first end has a first diameter, the holder second end has a second diameter, and the first diameter is smaller than the second diameter. The holder can have a rim for engagement with the liner. The liner can have a rim for engagement with the holder and the agitator. The holder body can have an outer surface having external threads. The fastening ring can have an inner surface having internal threads, and the external threads and the internal threads can be engageable for fastening the fastening ring to the holder. The holder body can have a slot formed therein. The slot can be two upper slots and two lower slots with the upper slots formed through an upper portion of the holder body and being diametrically opposed, and the lower slots formed through a lower portion of the holder body and being diametrically opposed. The assembly can further comprise a cap engageable with the fastening ring.

The present invention is also a method of mixing components in a container assembly having a holder, a flexible liner, an agitator, a nipple and a fastening ring. The steps comprise: (1) positioning the flexible liner in the holder with the liner having an open end and the holder having a first open end and a second end; (2) filling the liner with a first component and a second component; (3) inserting the agitator at least partially in the liner with the agitator having a plurality of apertures therethrough; (4) positioning the nipple adjacent the agitator; (5) positioning the fastening ring over the nipple; (6) securing the fastening ring to the holder to form the container assembly; and (7) shaking the container assembly to mix the first component and the second component. The method can further comprise the step of securing a cap to the fastening ring before shaking the container assembly. The method can further comprise the step of squeezing a lower portion of the liner to remove air.

DETAILED DESCRIPTION OF THE INVENTION

Figure 1:
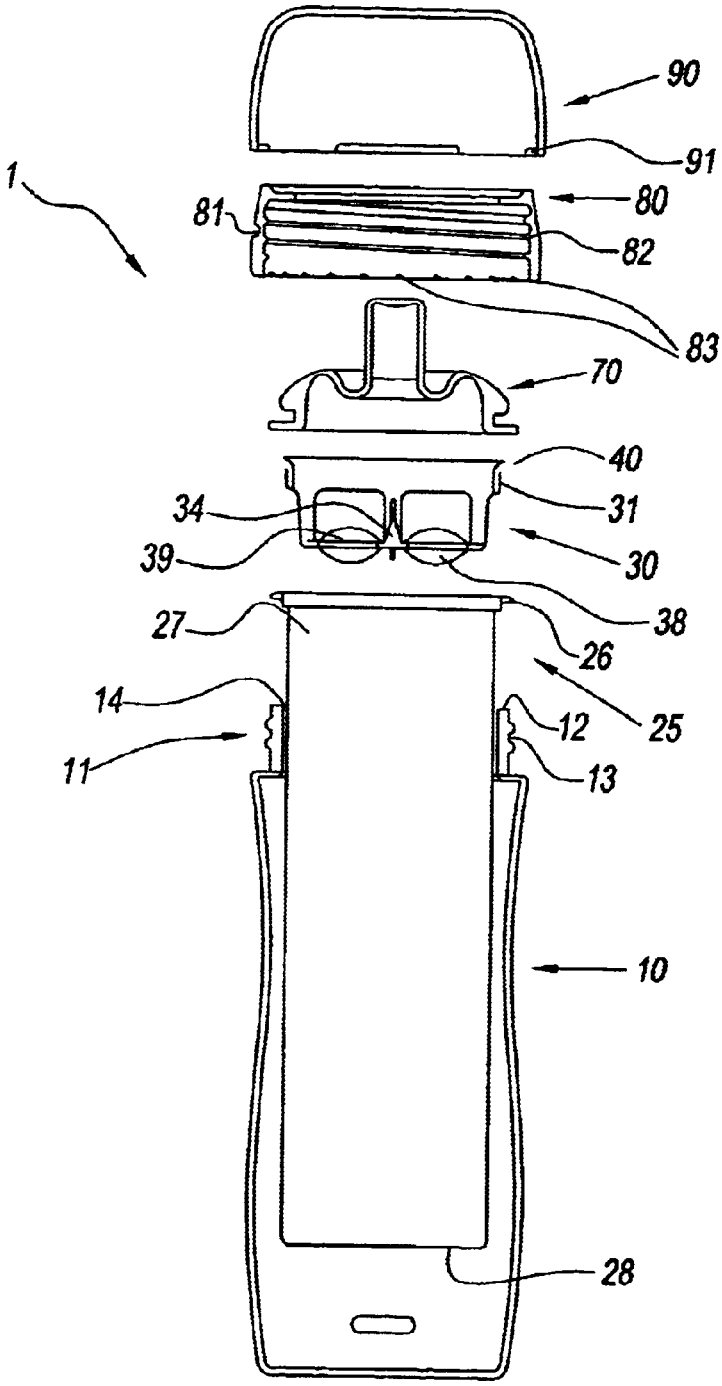
FIG. 1 is an exploded view of an infant feeding bottle system in accordance with a preferred embodiment of the present invention.

Referring to the drawings and in particular FIG. 1, there is shown an infant feeding bottle system in accordance with a preferred embodiment of the present invention generally represented by reference numeral 1. The infant feeding bottle system 1 has a holder 10 and an agitator 30. Preferably, infant bottle system 1 also has a nipple 70 and a fastening ring 80. The infant bottle system 1 may also have a cap 90.

The holder 10, which is preferably tubular, and has an upper end 11 with a rim 12 and an outer threaded portion 13. Rim 12 provides an opening 14 for receiving a liner 25. The liner 25 fits inside opening 14 and is supported by holder 10 by a lip 26 located on an upper end 27 of the liner. The liner 25 rests upon support rim 12 of the upper end 11 of holder 10. The liner 25 has a bottom 28. Preferably, liner 25 is a non-rigid and/or flexible liner. Also, preferably, liner 25 is disposable.

The agitator 30 also fits into opening 14 and seats down inside liner 25. The nipple 70 is positioned above agitator 30. The fastening ring 80 threadably engages holder 10 to secure nipple 70, agitator 30 and liner 25 firmly in position onto the upper end 11 of holder 10.

Figure 2:
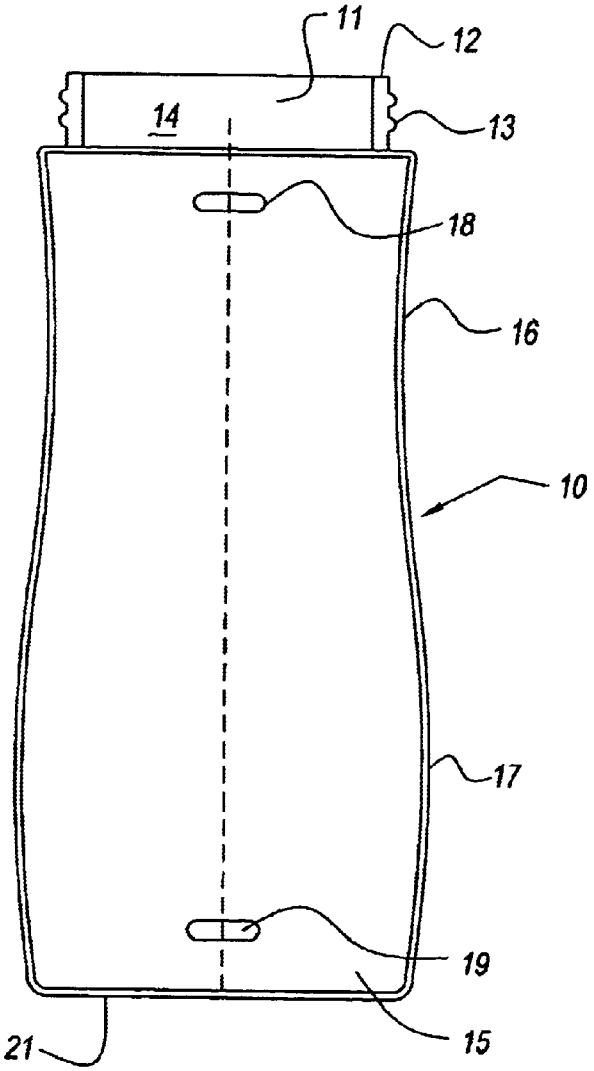
FIG. 2 is a side view of a tubular holder of the system of FIG. 1.
Figure 3:
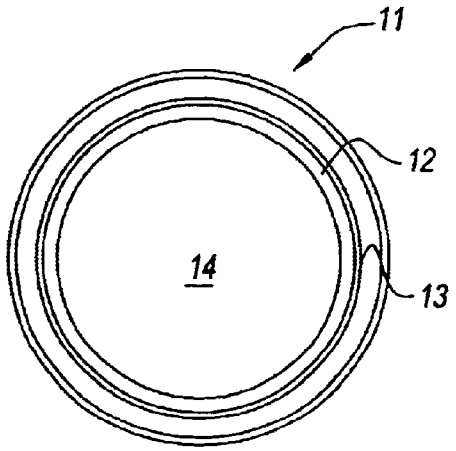
FIG. 3 is a top view of the tubular holder of FIG. 1.
Figure 4:
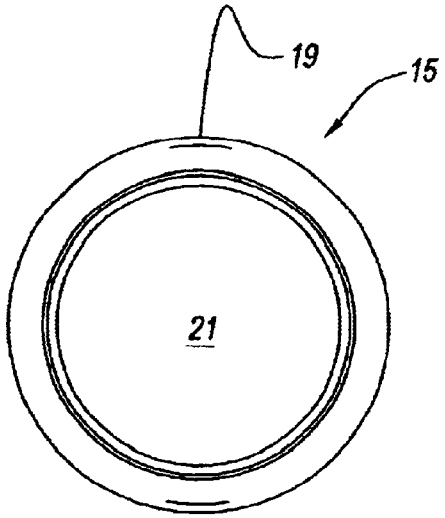
FIG. 4 is a bottom view of the tubular holder of FIG. 1.
Figure 5:
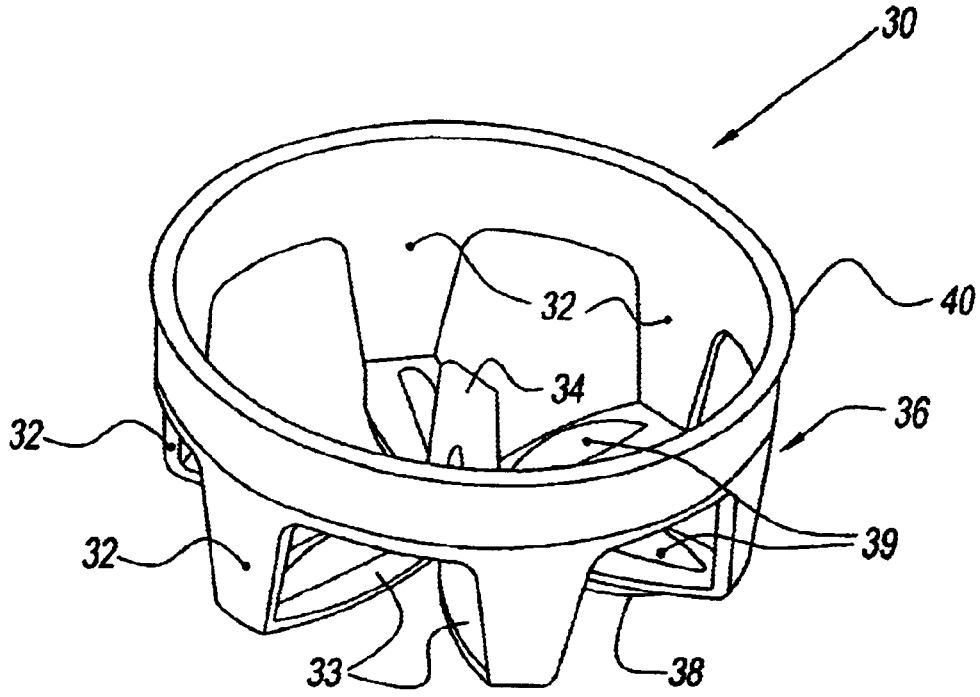
FIG. 5 is a perspective view of a first embodiment of the agitator with a handle of the system of FIG. 1.
Figure 6:
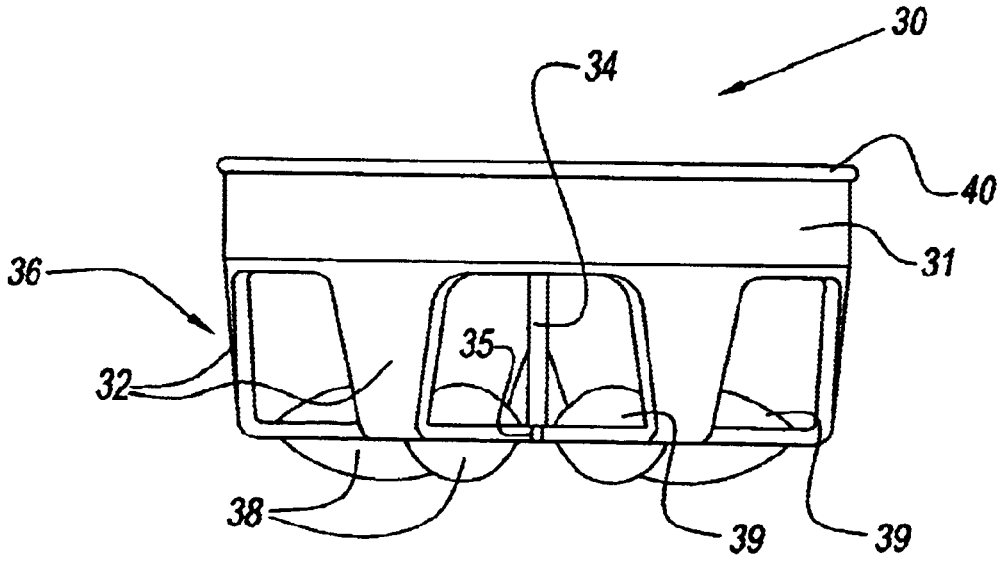
FIG. 6 is a side view of the first embodiment of the agitator with a handle of FIG. 1.
Figure 7:
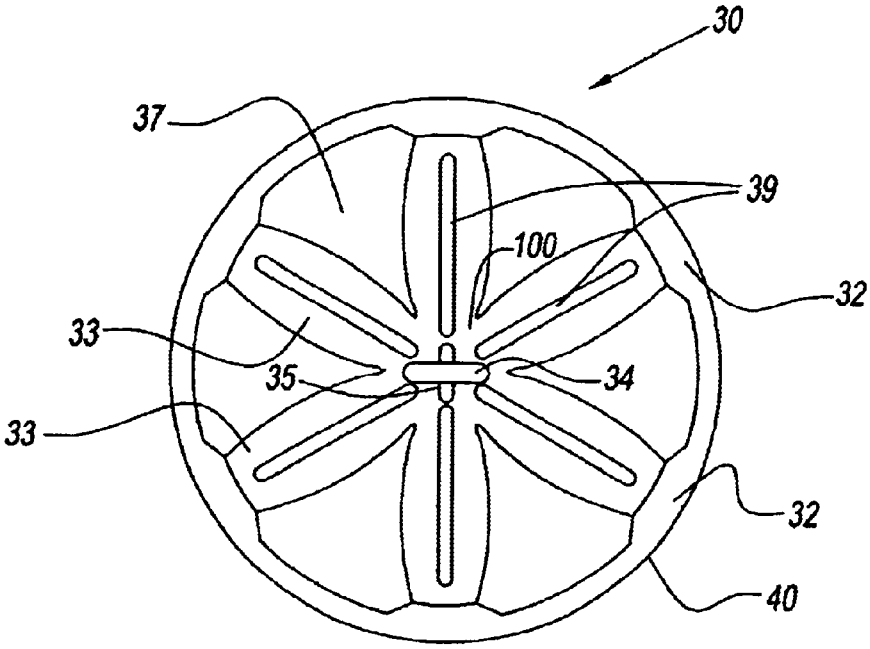
FIG. 7 is a top view of the first embodiment of the agitator with a handle of FIG. 1.
Figure 8:
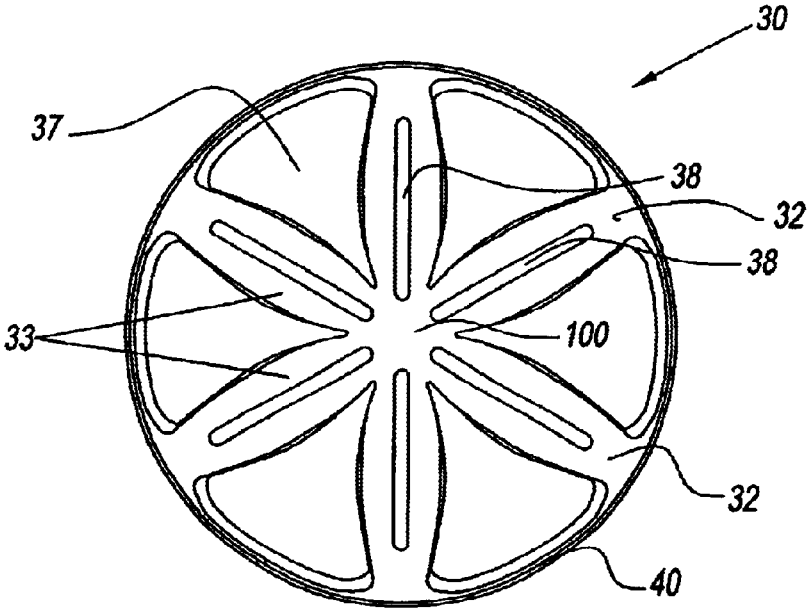
FIG. 8 is a bottom view of the first embodiment of the agitator with a handle of FIG. 1.
Figure 9:
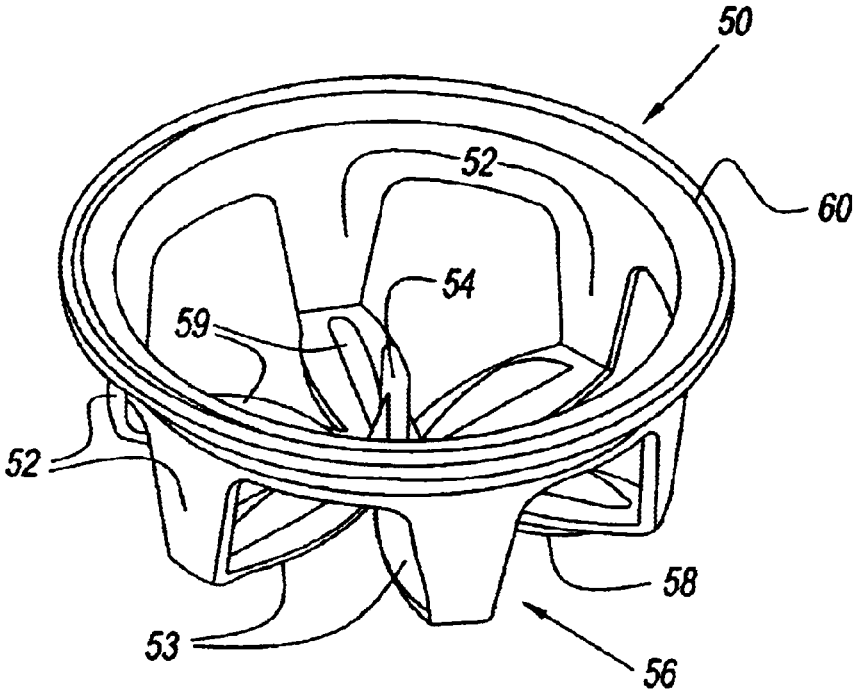
FIG. 9 is a perspective view of a second embodiment of the agitator with a handle of the system of FIG. 1.
Figure 10:
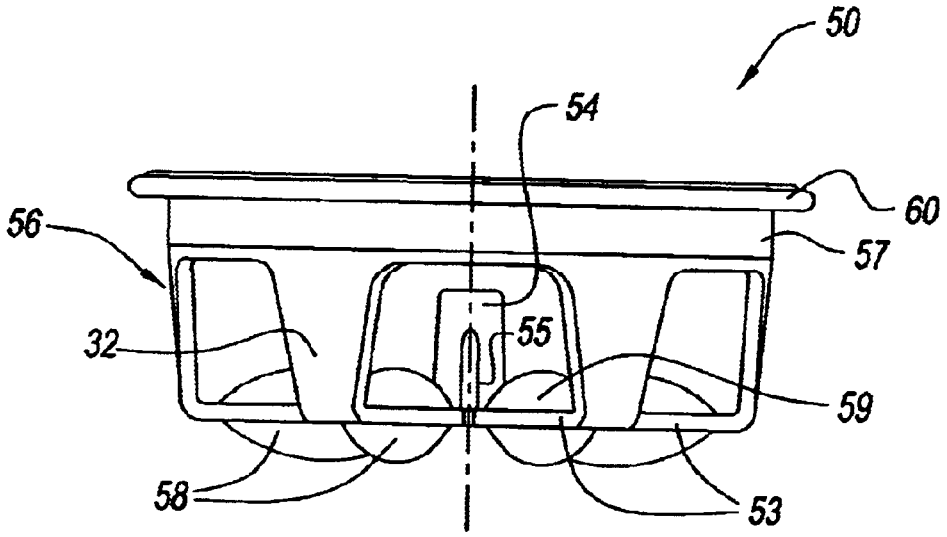
FIG. 10 is a side view of the second embodiment of the agitator with a handle of FIG. 1.
Figure 11:
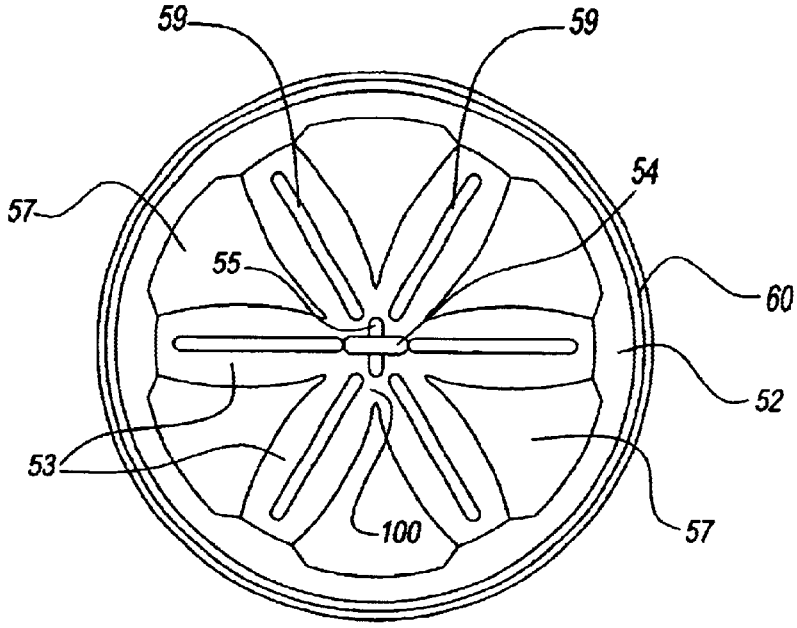
FIG. 11 is a top view of the second embodiment of the agitator with a handle of FIG. 1.
Figure 12:
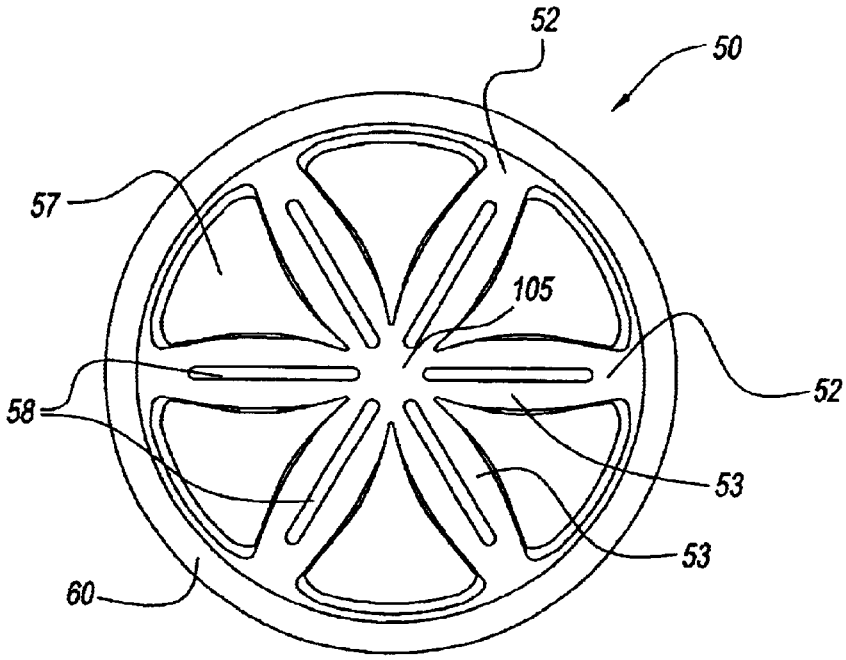
FIG. 12 is a bottom view of the second embodiment of the agitator with a handle of FIG. 1.

Referring to FIGS. 2 through 4, holder 10 preferably has a wider lower portion 17 and narrower upper portion 16. This configuration allows a user (infant and/or parent) to hold holder 10 more easily. Holder 10 is adapted to accommodate and support liner 25 as shown in FIG. 1. Holder 10 preferably has four side slots 18, 19. Two side slots 18 are preferably diametrically opposed, and are located in the upper portion 16 of holder 10. Two side slots 19 are also preferably diametrically opposed, and are located in the upper portion 17 of holder 10. These side slots 18, 19 allow holder 10 to stand upright in a pot of heated water and improve liquid flow during bottle warming. Holder 10 preferably has a bottom opening 21. The bottom opening 21 is sufficiently large to allow a user to press bottom 28 of liner 25 to force out all excess air contained in the liquid formula mix.

Referring to FIGS. 5 through 8, there is shown a preferred agitator 30 of the present invention. The agitator 30 has an annular ring 31, a plurality of partitions 32 extending from ring 31, and a plurality of spokes 33. Each spoke 33 is connected at one end with a different partition 32. Spokes 33 are connected together at the other end of each of the spokes at a hub 35.

The annular ring 31 has a diameter of sufficient size to fit snugly in holder 10. Ring 31 also has an outward protruding bead 40 that runs along the upper outer circumference of ring 31. The bead 40 is adapted to rest tightly against lip 26 to securely hold liner 25 in position against rim 12.

The plurality of wall partitions 32 are preferably uniformly spaced and extend downward from ring 31 and, preferably, slightly inward toward the center axis of agitator 30. The plurality of spokes 33 are also preferably uniformly spaced apart. Each spoke 33 is connected to a different partition 32 and radiates toward the center axis of agitator 30 towards hub 35. The ends of spoke 33 meet at hub 35. Hub 35 can form a handle 34 for agitator 30. Preferably, each spoke 33 is integrally formed with its corresponding partition 32. An aperture 37 separates each adjacent pair of spokes 33. Since the plurality of spokes 33 extend radially outward for a distance and merge with the downwardly extending wall partitions 32, the spokes and partitions form a cup-like structure 36.

At area 100, there is preferably provided a centrally located handle 34. The handle 34 functions to ease the insertion and removal of agitator 30 from holder 10.

Each spoke 33 has at least one fin, and preferably a pair of fins. The fins include a lower fin 38 connected to a first, bottom surface of spokes 33 and an upper fin 39 connected to a second, upper surface of spokes 33 opposite the first surface. The pair of fins 38, 39 function to increase and improve the shearing action and turbulent flow of fluid during the mixing/shaking process.

Referring to FIGS. 9 through 12, there is shown a second or alternative agitator 50 of the present invention. The agitator 30 has an annular ring 51, a plurality of partitions 52 extending from ring 51, and a plurality of spokes 53 each connected at a one end a different partition 52 with the other end of each of the spokes connected together at a hub 55.

Like the first or preferred embodiment shown in FIGS. 5 through 8, the annular ring 51 has a diameter of sufficient size to fit snugly in holder 10. However, unlike the first embodiment, ring 31 also has an outward protruding bead 40 that runs along the upper outer circumference of ring 31. The bead 40 is adapted to rest tightly against lip 26 to securely hold liner 25 in position against rim 12.

As with the first embodiment, the plurality of wall partitions 52 are preferably uniformly spaced and extend downward from ring 51 and, preferably, slightly inward toward the center axis of agitator 50. The plurality of spokes 53 are also preferably uniformly spaced apart. Each spoke 53 is connected to a different partition 52 and radiates toward the center axis of agitator 50 towards hub 55. The ends of spoke 53 meet at hub 55. Hub 55 can form a handle 54 for agitator 50. Preferably, each spoke 53 is integrally formed with its corresponding partition 52. An aperture 57 separates each adjacent pair of spokes 53. Since the plurality of spokes 53 extend radially outward for a distance and merge with the downwardly extending wall partitions 52, the spokes and partitions form a cup-like structure 56.

At area 105, there is preferably provided a centrally located handle 54. The handle 54 functions to ease the insertion and removal of agitator 50 from holder 10 and liner 25.

Each spoke 53 has at least one fin, and preferably a pair of fins. The fins include a lower fin 58 connected to a first, bottom surface of spokes 53 and an upper fin 59 connected to a second, upper surface of spokes 53 opposite the first surface. The pair of fins 58, 59 function to increase and improve the shearing action and turbulent flow of fluid during the mixing/shaking process.

Figure 13:
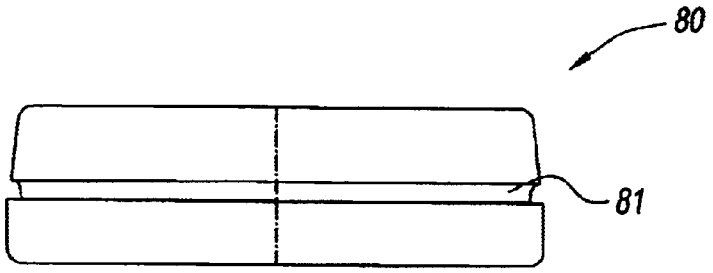
FIG. 13 is a side view of a fastening ring of the system of FIG. 1.
Figure 14:
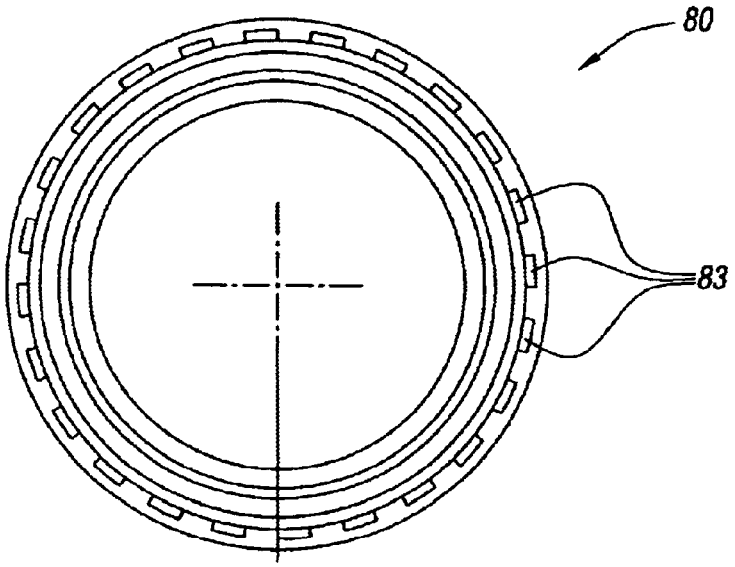
FIG. 14 is a bottom view of the fastening ring of FIG. 1.
Figure 15:
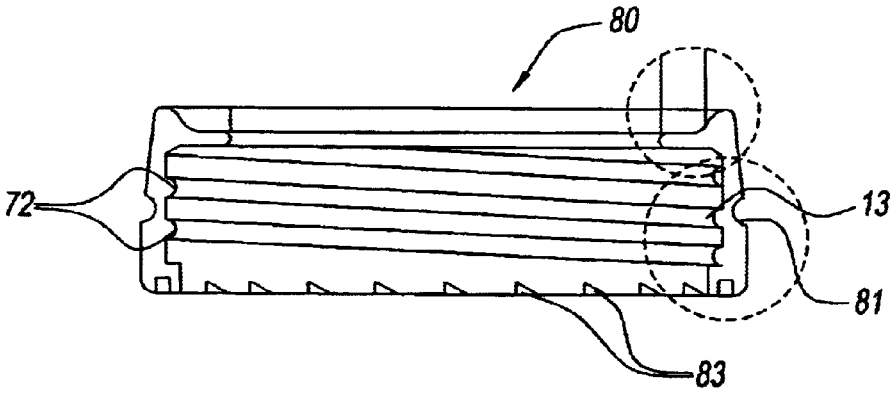
FIG. 15 is a side section view of the fastening ring threadably engaged with the tubular holder of FIG. 1.
Figures 16, 17, 18:
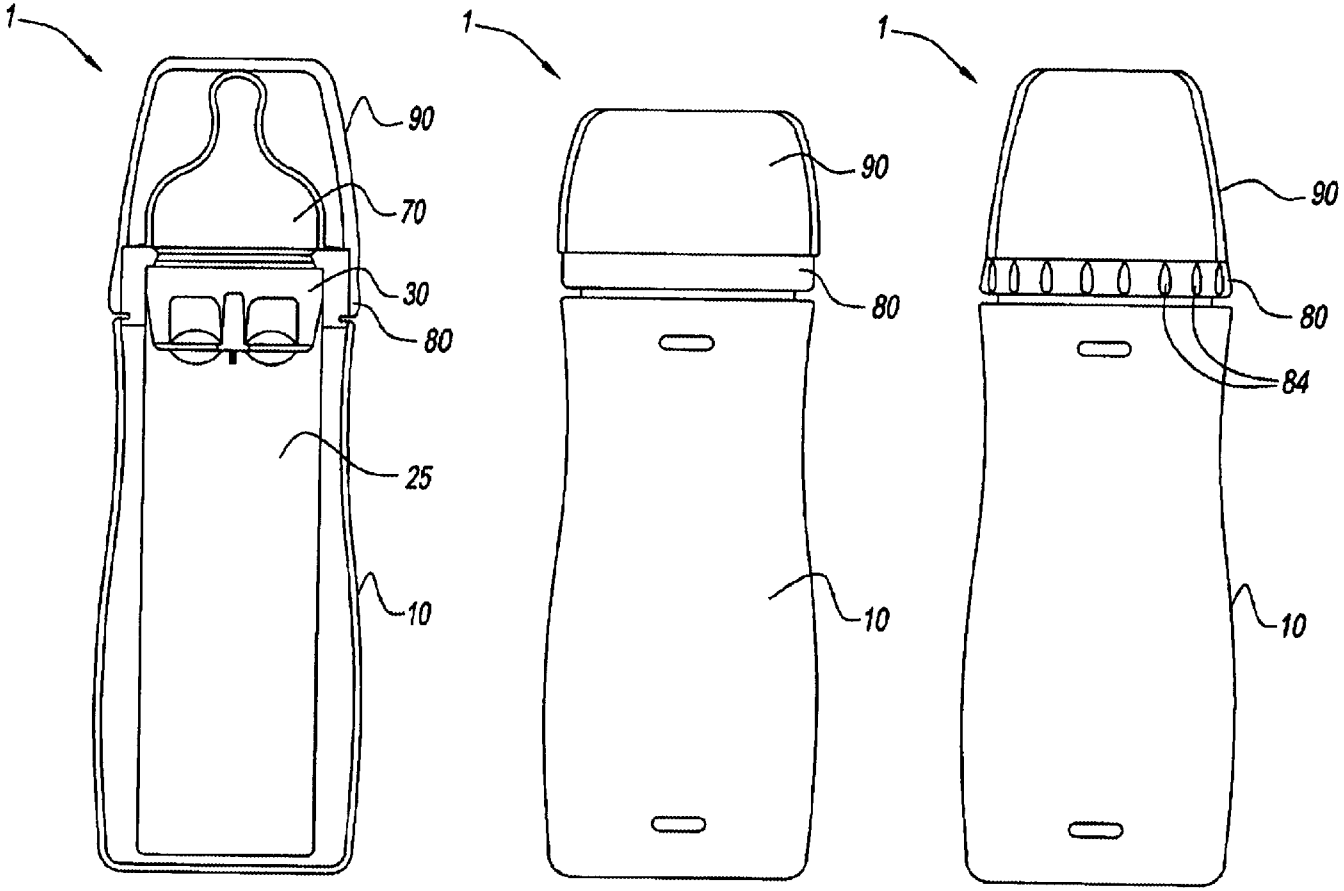
FIG. 16 is a side section view of the infant feeding bottle system of FIG. 1, as assembled.
FIG. 17 is a side view of a first embodiment of the infant feeding bottle system of FIG. 1.
FIG. 18 is a side view of a second embodiment of the infant feeding bottle system of FIG. 1.

Referring to FIGS. 13 through 15, fastening ring 80 has an inner threaded portion 82 that is adapted to rotatably engage the outer threaded portion 13 of upper end 11 of holder 10. The liner 25, agitator 30 and nipple 70 all fit together and are engaged between fastening ring 80 and holder 10 when fastening ring 80 is secured with the outer threaded portion 13 of upper end 11 of holder 10. Fastening ring 80 preferably also has an annular groove 81 that runs centrally along the outer circumference of fastening ring 80. The fastening ring 80 can receive a lip 91 that protrudes inwardly from the inner surface of cap 90 as shown in FIG. 1. Referring to FIG. 18, fastening ring 80 can also have grippers 84 located on its outer circumference. The grippers 84 aid a user in rotating fastening ring 80 to engage and/or disengage with outer threaded portion 13 of upper end 11 of holder 10.

FIGS. 16 through 18 show the assembled system 1. To use system 1 of the present invention, the following steps may be employed: (1) fill liner 25 with liquid, preferably an appropriate amount of liquid and add the corresponding amount of powdered formula into liner 25; (2) insert agitator 30 into liner 25 with ring 31 (holding lip 26 firmly in position); (3) position nipple 70 atop agitator 30, fastening ring 80 over both nipple 70 and agitator 30 and secure fastening ring 80 to holder 10; (4) (ensure fastening ring 80, nipple 70, agitator 30 and liner 25 are all securely positioned) optionally, but preferably, place cap 90 over nipple 70 and fastening ring 80 until lip 91 of cap 90 fits into groove 81 of fastening ring 80, thus holding cap 90 in place; (5) shake bottle 1 to dissipate powdered formula into the liquid; and (6) remove cap 90 and press bottom 28 of liner 25 to force out all excess air contained in the liquid formula mix. Thereafter, one can commence with feeding of an infant.

The bottle system permits a user to mix powdered formula directly inside a non-rigid liner. The bottle system enhances the mixing effect, resulting in improved solubility, and provides for a self-contained uninterrupted mixing and feeding process.

The present invention having been thus described with particular reference to the preferred forms thereof, it will be obvious that various changes and modifications may be made therein without departing from the spirit and scope of the present invention as defined in the appended claims.

What is claimed is:

1. An agitator for mixing components in a container assembly having a flexible liner, the agitator comprising:

an annular ring forming a hole therethrough;

a spoke having a fin and forming a plurality of apertures; and a plurality of partitions for connecting said spoke to said annular ring, wherein said annular ring, said spoke and said plurality of partitions form a cup-like structure, wherein said hole of said annular ring is disposed in a first planar section and said spoke is disposed in a second planar section, and wherein said first and second planar sections are substantially parallel to each other and separated by said plurality of partitions.

2. The agitator of claim 1, wherein said annular ring has an outer surface and a securing member for disposing the agitator at least partially in said flexible liner.

3. The agitator of claim 2, wherein said securing member is an annular bead extending from said outer surface.

4. The agitator of claim 1, wherein said fin is an upper fin and a lower fin.

5. The agitator of claim 1, wherein said fin is disposed in a third planar section, and said first and third planar sections are substantially perpendicular to each other.

6. The agitator of claim 1, wherein said annular ring has a longitudinal center axis and said plurality of partitions extend from said annular ring towards said axis.

7. The agitator of claim 1, wherein said plurality of partitions are substantially equally spaced apart.

8. The agitator of claim 1, wherein said spoke is a plurality of spokes and each of said plurality of spokes has a first end and a second end, and wherein said first ends are connected to said plurality of partitions and said second ends are connected to each other at a hub.

9. The agitator of claim 8, wherein said hub is centrally located.

10. The agitator of claim 9, wherein said hub has a handle.

11. The agitator of claim 9, wherein said plurality of spokes are substantially equally spaced apart.

12. A container assembly for mixing components in a flexible liner, the assembly comprising:

a holder having a body with a first open end and a second end;

a flexible liner having an open end and an inner volume;

an agitator having an annular ring with an outer surface;

a nipple; and a fastening ring, wherein said holder, said liner, said agitator, said nipple and said fastening ring are connected together to form the assembly, wherein said annular ring is at least partially disposed through said open end of said liner and in said inner volume, and wherein said outer surface of said annular ring is disposed at least partially in said inner volume and adjacent to said liner to provide a fit amongst said annular ring, said liner and said holder.

13. The assembly of claim 12, wherein said agitator further comprises a connecting member and a spoke having a fin, wherein said annular ring forms a hole therethrough, and wherein said connecting member secures said spoke to said annular ring and said spoke forms a plurality of apertures.

14. The assembly of claim 13, wherein said fin is an upper fin and a lower fin.

15. The assembly of claim 13, wherein said annular ring, said connecting member am said spoke form a cup-like shape.

16. The assembly of claim 13, wherein said hole is in a first plane, said spoke is in a second plane, and said first plane and said second plane are substantially parallel.

17. The assembly of claim 13, wherein said hole is in a first plane, said fin is in a third plane, and said first plane and said third plane are substantially perpendicular.

18. The assembly of claim 13, wherein said connecting member is a plurality of partitions.

19. The assembly of claim 18, wherein said annular ring has a longitudinal center axis, and wherein said plurality of partitions extend from said annular ring towards said axis.

20. The assembly of claim 19, wherein said plurality of partitions are substantially equally spaced apart.

21. The assembly of claim 13, wherein said spoke is a plurality of spokes, each of said plurality of spokes has a first end and a second end, each of said first ends are connected to said connecting member and each of said second ends are connected to each other at a hub.

22. The assembly of claim 21, wherein said hub has a handle.

23. The assembly of claim 21, wherein said hub is centrally located.

24. The assembly of claim 23, wherein said plurality of spokes are substantially equally spaced apart.

25. The assembly of claim 12, wherein said annular ring has a securing member for fastening said agitator to said liner.

26. The assembly of claim 25, wherein said securing member is an annular bead extending from said outer surface.

27. The assembly of claim 12, wherein said second end of said holder is open.

28. The assembly of claim 12, wherein said first end of said holder has a first diameter, said second end of said holder has a second diameter, and said first diameter is smaller than said second diameter.

29. The assembly of claim 12, wherein said holder has a rim for engagement with said liner.

30. The assembly of claim 12, wherein said liner has a rim for engagement with said holder and said agitator.

31. The assembly of claim 12, wherein said holder body has an outer surface having external threads, said fastening ring has an inner surface having internal threads, and said external threads and said internal threads are engageable for fastening said fastening ring to said holder.

32. The assembly of claim 12, wherein said holder body has a slot formed therein.

33. The assembly of claim 32, wherein said slot is a plurality of upper slots and a plurality of lower slots, said plurality of upper slots formed through an upper portion of said holder body and being diametrically opposed, and said plurality of lower slots formed through a lower portion of said holder body and being diametrically opposed.

34. The assembly of claim 12, further comprising a cap engageable with said fastening ring.

35. A method of mixing components in a container assembly having a holder, a flexible liner, an agitator, a nipple and a fastening ring, the steps comprising:

positioning the flexible liner in the holder, said liner having an open end and said holder having a first open end and a second end;

filling said liner with a first component and a second component;

inserting the agitator at least partially in said liner, said agitator having a plurality of apertures therethrough;

positioning the nipple adjacent said agitator;

positioning the fastening ring over the nipple;

securing said fastening ring to said holder to form the container assembly; and shaking the container assembly to mix said first component and said second component.

36. The method of claim 35, further comprising the step of securing a cap to said fastening ring before shaking the container assembly.

37. The method of claim 35, further comprising the step of squeezing a lower portion of said liner to remove air.

38. The method of claim 35, wherein said liner has an inner volume, and wherein said agitator has an annular ring and a spoke forming said plurality of apertures, the method further comprising the step of inserting said agitator at least partially in said liner so that said spoke and said annular ring are at least partially disposed in said inner volume.

* * * * *